United States Patent [19]

Lampinen et al.

[11] 4,296,545

[45] Oct. 27, 1981

[54] CASING HOOK USED TO IMPREGNATE CHOKE OR TRANSFORMER

[75] Inventors: Esko Lampinen, Helsinki; Kari Kajavo, Espoo, both of Finland

[73] Assignee: Oy Helvar, Helsinki, Finland

[21] Appl. No.: 135,890

[22] Filed: Mar. 31, 1980

[51] Int. Cl.[3] ..... H01F 41/00

[52] U.S. Cl. ..... 29/602 R; 29/418; 118/35; 118/500; 174/DIG. 2; 336/68; 427/289

[58] Field of Search ..... 29/602 R, 418, 423; 174/DIG. 2; 336/65, 66, 67, 68, 90, 98; 118/35, 500; 427/289, 433

[56] References Cited

U.S. PATENT DOCUMENTS

| | | | |
|---|---|---|---|
| 943,264 | 12/1909 | Niedringhaus | 427/433 X |
| 1,731,894 | 10/1929 | Frisch | 336/90 X |
| 2,211,690 | 8/1940 | Edwards | 336/67 |
| 2,211,691 | 8/1940 | Edwards | 336/67 X |
| 2,887,242 | 5/1959 | Grau | 336/90 X |
| 3,110,873 | 11/1963 | Mittenmaier | 336/67 X |

*Primary Examiner*—Thomas J. Kozma

*Attorney, Agent, or Firm*—Zarley, McKee, Thomte, Voorhees & Sease

[57] ABSTRACT

A plurality of hooks, which are of one-piece construction with a casing substantially enclosing a transformer or choke, are engaged by a suspension means which allows the casing, exclusive of the hooks, to be immersed in an impregnating agent. After impregnation, the casing and enclosed choke or transformer are removed from the impregnant and air dried. The hooks and suspension means are not immersed in the impregnating agent.

6 Claims, 3 Drawing Figures

CASING HOOK USED TO IMPREGNATE CHOKE OR TRANSFORMER

Chokes or transformers are generally impregnated by dipping them completely in an impregnating lacquer. A problem here is that the means for conveying a choke or transformer through the impregnation vessel are also exposed to the impregnating lacquer which gradually deposits on such conveyor means. These must be cleaned from time to time.

The object of the invention is to provide a choke or transformer which can be impregnated by dipping it in impregnating lacquer without exposing conveyor means to the lacquer.

According to the invention, this object is achieved so that the choke or transformer is provided with hooks which are integral with its structural section and which can be gripped by a suspension rod for conveying the chokes through an impregnation vessel, said hooks being cut off a ready-made choke or transformer. The suspension rod can be used to grip simultaneously the hooks of a plurality of adjacent chokes and to pass a line of chokes through the vessel with the rod being kept clear of the impregnating lacquer. Following the impregnation, said suspension hooks can be cut off.

The most simple approach is to cut and bend the hooks off the sheet metal casing of a choke or transformer. Thus in successive sheet metal casings, the hooks can be cut off without material waste in such a manner that the sections between the hooks and the long sides of the casing are cut off and bent to provide protective flaps for the gables of a choke or transformer. This eliminates the earlier need for a separate gable plate.

During the impregnation step when draining the lacquer, that gable edge of the casing bottom, which lies opposite to suspension hooks, collects a lacquer pod with a consequence that the base of a choke, fitted on an illuminator body, will stay a few tenths of a millimeter off the illuminator body. This is undesirable in view of heat conduction and may lead to overheating of the choke. According to a preferred embodiment of the invention, the edge of the casing bottom is bent upwards, i.e. away from the base surface, said bending being effected in the opposite gable with respect to the suspension hooks. This is to ensure the surface contact between the casing bottom and the illuminator body.

Figure 1:
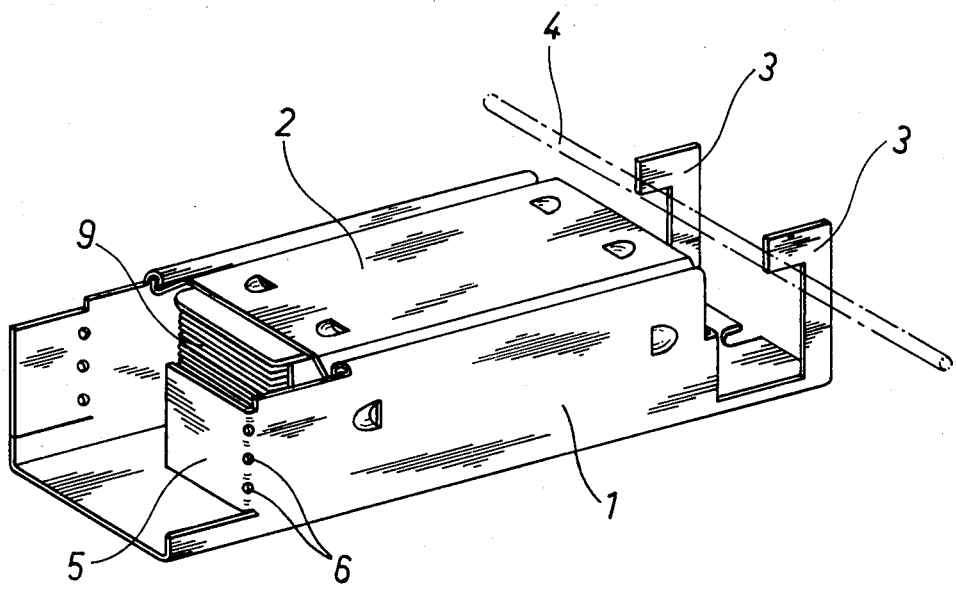
Figure 2:
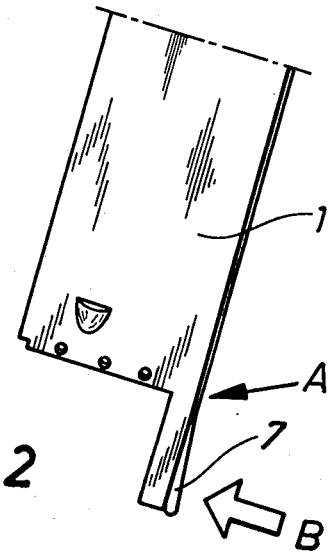
Figure 3:
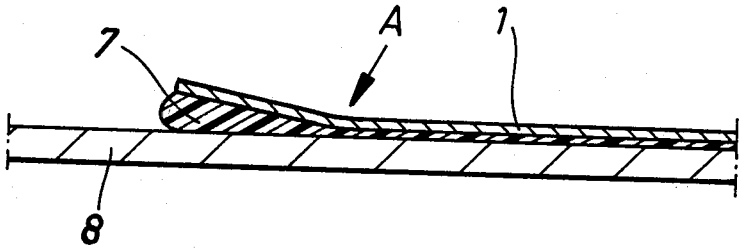

In the following an embodiment of the invention will be explained in more detail with reference made to the accompanying drawings, in which:

FIG. 1 is a perspective view of a choke of the invention fitted with a sheet metal casing, FIG. 2 is a side view of the choke gable after the impregnation step, and FIG. 3 is an enlarged-scale sectional presentation of bending of the edge of the choke bottom.

The sheet metal casing of a choke, including its bottom and side walls, has been integrally made from a metal sheet by punching and bending. A cover section 2 is made separately and secured by its edges to the edges of the casing 1 after the choke coil 9 has been collected inside the casing 1. The standardized bottom section of the casing determines the length of a blank metal sheet. Thus, it is possible without waste material to provide suspension hooks 3 in one end of the casing 1, a suspension rod 4 being capable of gripping said hooks. With a plurality of chokes ready for impregnation resting adjacent each other, the long suspension rod 4 slides on the top of the chokes and drops in the space between the cover 2 and hooks 3, flaps having been bent therefrom to protect the choke gable. As its movement proceeds, the suspension rod 4 picks up the line of chokes. The shape and dimensions of the hooks 3 are such that, as the suspension rod 4 is lifted up, the chokes will be suspended in a position slightly deviating from vertical. The line of chokes can be passed through a lacquer vessel, so that the chokes are completely dipped in the lacquer with the exception of top portions of the hooks 3. thus, the suspension rod 4 need not be dipped in the vessel, either, which leads to the advantage that the need for cleaning the suspension rod is eliminated. Following the impregnation, the hooks can be severed off, thus leaving only the severed surface without impregnation.

Also in the other end of the casing it is possible to take advantage of the blank sheet material without material waste. When earlier the end shield of a choke has comprised a gable plate made of a separate sheet, according to the invention there are flaps 5 cut off and bent for protection of the gable. To facilitate bending, the bending line can be provided with a weakening perforation 6 simultaneously with punching.

When drying such impregnated chokes by suspending on the suspension hooks 3, the running impregnating lacquer provides along the opposite edge of bottom a lacquer pod 7 which is thicker than the rest of the lacquer layer. According to the invention, the edge of the casing bottom is bent along a line A in the direction of an arrow B to provide, as depicted in FIG. 3, surface contact between the bottom of the casing 1 and a base surface, such as an illuminator body 8.

We claim:

1. A method of conveying chokes or transformers through an impregnation vessel containing an impregnating agent comprising:

forming a plurality of hooks which are of one-piece construction with a casing substantially enclosing said choke or transformer;

engaging said hooks with a suspension means;

suspending said casing and enclosed choke or transformer from said hooks;

immersing said suspended casing and enclosed choke or transformer, exclusive of said hooks and said suspension means, in said impregnating agent for periods sufficient to allow impregnation;

and removing said casing and enclosed choke or transformer from said impregnating agent while said hooks remain engaged by said suspension means;

whereby said casing and enclosed choke or transformer are impregnated with said agent and air dried without immersing said hooks or said suspension means.

2. A method according to claim 1 further comprising: removing said hooks after the removal of said casing.

3. A method according to claim 2 wherein said casing is an open ended sleeve of rectangular cross section having a top, bottom and two sides, which extends beyond said choke or transformer at each end exclusive of the top thereof, and said hooks are formed by making parallel notches adjacent one end.

4. A method according to claim 3 further comprising: after said removing, cutting along said sides to a point adjacent said transformer, along a line immediately above the junction of said sides and said bottom, and bending the sections of said sides between the choke or transformer and the ends approximately 90° towards said casing, said sections being on oppositely disposed sides, whereby end flaps for said choke or transformer are formed and only said bottom extends beyond said choke or transformer.

5. The method of claim 4 further comprising:

perforating said sections along the bending line.

6. The method of claim 4 wherein said casing is suspended at an angle with respect to vertical whereby the end of the bottom surface opposite said hooks is farther from the vertical than said choke or transformer, and bending said opposite end toward said choke or transformer, whereby when said impregnating agent dries on said bottom, the portion of said bottom which is not bent will lie flat on a flat surface.

* * * * *